United States Patent [19]
MacGraw, II
[11] 4,238,905
[45] Dec. 16, 1980

[54] SCULPTURAL OBJECTS

[76] Inventor: Richard MacGraw, II, 600 W. 113th St., New York, N.Y. 10025

[21] Appl. No.: 934,531

[22] Filed: Aug. 17, 1978

Related U.S. Application Data

[63] Continuation-in-part of Ser. No. 673,140, Apr. 2, 1976, abandoned, which is a continuation-in-part of Ser. No. 164,588, Jul. 21, 1971, abandoned.

[51] Int. Cl.[3] ..... A63H 33/06; A63H 33/26
[52] U.S. Cl. ..... 46/25; 46/241
[58] Field of Search ..... 46/24, 25, 241; 35/72

[56] References Cited

U.S. PATENT DOCUMENTS

| | | | |
|---|---|---|---|
| 1,236,234 | 8/1917 | Troje | 46/23 |
| 2,570,625 | 10/1951 | Zimmerman et al. | 46/24 |
| 2,795,893 | 6/1957 | Vayo | 46/24 |
| 2,839,841 | 6/1958 | Berry | 46/23 |
| 2,872,754 | 2/1959 | Cronberger | 46/26 |
| 2,939,243 | 6/1960 | Duggar | 46/24 |
| 3,184,882 | 5/1965 | Vega | 46/25 |
| 3,561,146 | 2/1971 | Dembar | 35/69 UX |
| 3,659,360 | 5/1972 | Zeischegg | 46/17 |

*Primary Examiner*—F. Barry Shay

[57] ABSTRACT

Sets of blocks, each set being a plurality of similarly shaped polyhedrons having faces of at least two different polygonal shapes. A set may consist of truncated octahedrons, of pentagonal prisms or of dodecahedrons. Magnetic or other means are provided in the faces so that matching faces may be joined and the blocks of a set built up in a large variety of close packing arrays without overlapping or interstices between the blocks. The blocks may be solid or hollow and may be coated with metallic material.

4 Claims, 9 Drawing Figures

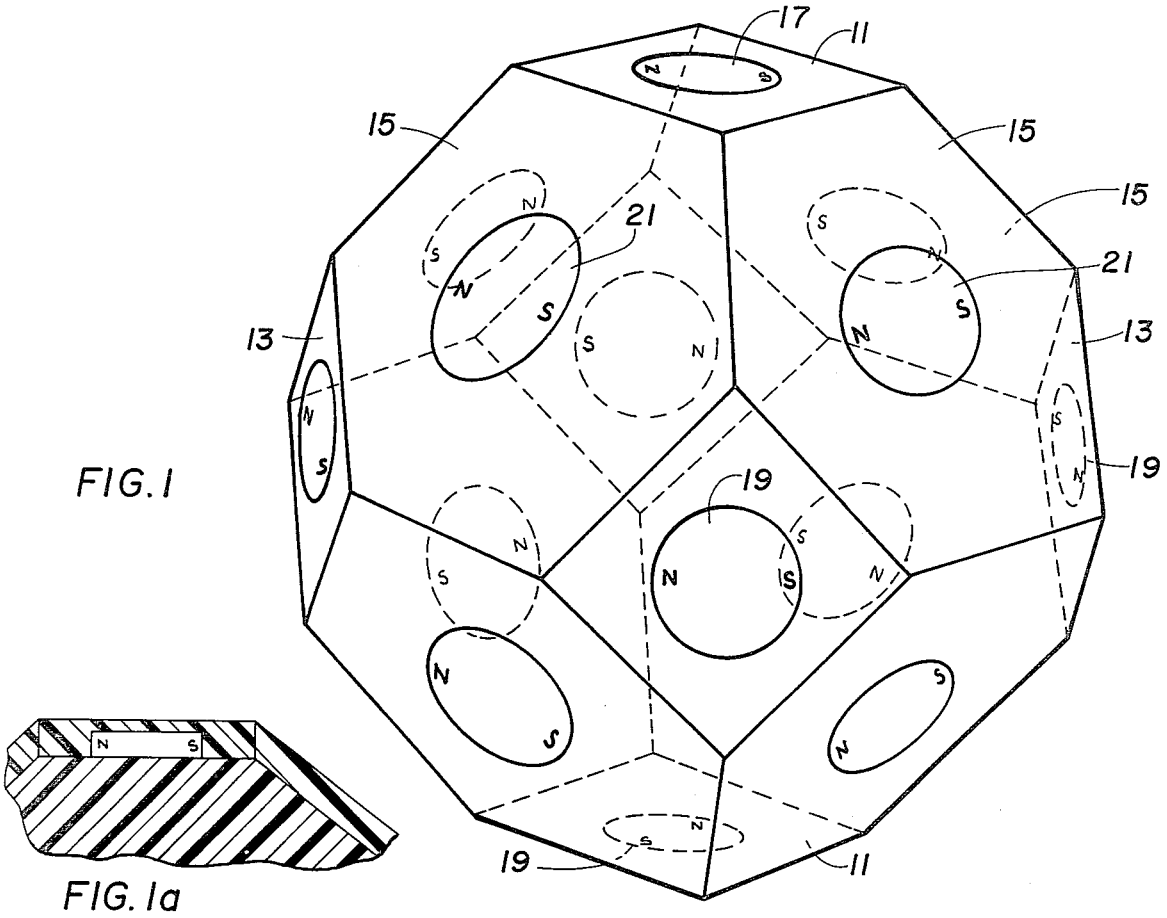
FIG. 1
FIG. 1a
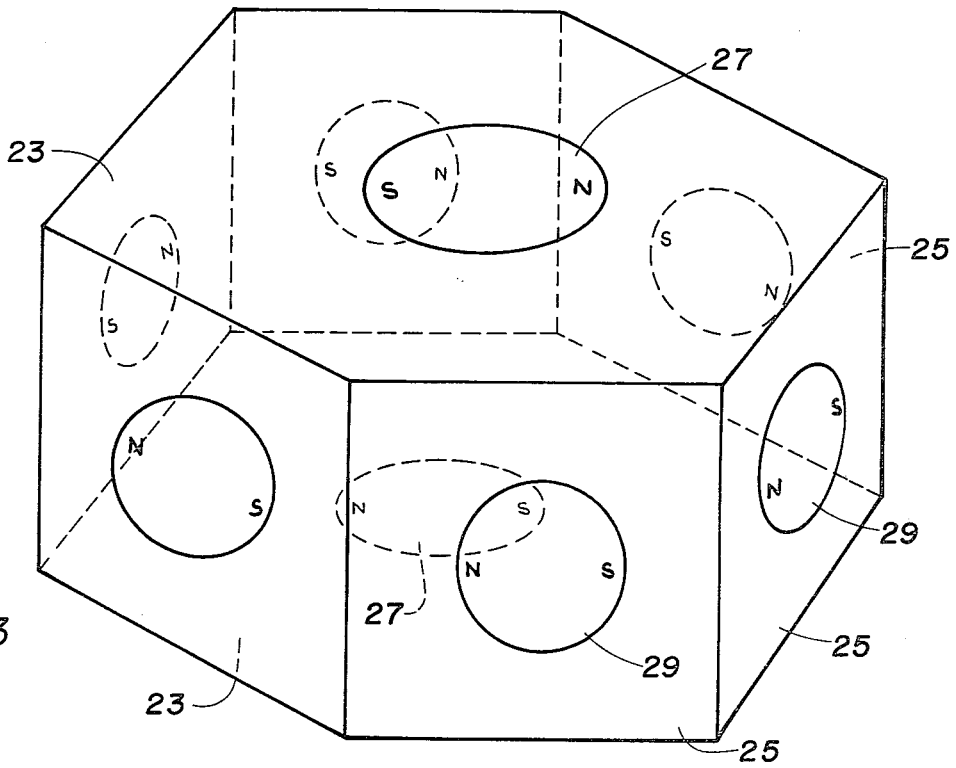
FIG. 3

SCULPTURAL OBJECTS

This application is a continuation-in-part of Ser. No. 673,140, filed Apr. 2, 1976, now abandoned, which in turn was a continuation-in-part of Ser. No. 164,588, filed July 21, 1971, now abandoned.

BACKGROUND OF THE INVENTION

The present invention relates to changeable sculptural objects useful as an ornament and/or amusement device. In particular the present invention relates to a combination of a plurality of objects each having a geometric solid shape cooperating with each other permitting a plurality of them to be selectively and separably arranged in abutting relationship to form architectural, sculptural, and/or amusing arrangements.

The present invention is directed to the use of three dimensional figures or bodies, commonly referred to as "geometric solids". It is to be understood that such bodies may be "solid" in density, hollow, partially hollow or even a framework of sides, faces, angles, etc.

While an infinite number of solid shapes are in existence, there is only a finite number of such forms which have the property of filling a three dimensional space by repeated translations and repetitions. This space-filling property or close packing property (i.e. without overlapping or having interstices between adjacent units) is capable with such forms as the cube, the hexagonal prism, the truncated octahedron (Kelvin's solid), the rhombic dodecahedron, rhombic cube and Murray's dodecahedron. Other solids have this interesting property.

It was known to utilize the cube in repetitive manner as a structural or architectural unit and even as a toy unit or block to provide interesting artistic and amusing forms. Such devices, however, depended on gravitational and weight forces to build desired combinations of plural units, or on fixed and secure fastening devices to hold the units together. Free form designs and configurations, such as cantilevered, hanging, or radial arrangements, etc. cannot be made with the conventional devices. Furthermore, the degree of freedom to change and modify the configuration, as desired, is severely limited by the use of fastening means. Above all it was impossible to provide forms having multiple units which can be arranged in an infinite variety and be susceptible of easy and ready change.

According to the present invention the uniform shapes capable of being arranged to fill a given space or volume by "close packing" when provided with magnetic means in a defined pattern and in selected faces permits the formations of structural, architectural and amusing forms of an infinite variety.

It is the object of the present invention to provide a combination of devices capable of being spatially releasably connected in an infinite variety of forms or arrangements.

It is another object of the presnt invention to provide an improved ornamental, sculptural, and amusement device comprising a plurality of geometric shapes capable of being separably arranged in a variety of overall combinations.

It is a further object of the present invention to provide a combination of geometric blocks having magnetic adhering means, capable of being arranged in infinite variety.

SUMMARY OF THE INVENTION

According to the present invention a plurality of shapes, such as those of any one of the geometric solids defined are provided with magnet means in each of its faces, the magnet means being arranged with their magnetic axes along selected directions so that one or more of the solids may be adhered to each other in selectively defined arrangements.

The individual units may then be arranged with selected faces abutting each other in repetitive units of any desired number to form a variety of structural or simulated architectural shapes. The magnet means permit the units to hold themselves together in adherence, but allow the construction to be readily disassembled and reassembled in another form. Moreover, the magnet means, because of its inherent polarity provides a degree of experimentation and trial and error in order to arrange suitable faces together in releasably connected relationship.

A full description of the present invention, in which its objects, and advantages are illuminated follows herein.

BRIEF DESCRIPTION OF THE DRAWINGS

In order to understand the invention more fully, attention is directed to the following specification which is to be taken in conjunction with the accompanying drawings, wherein:

FIG. 1 is an illustration of a truncated regular octahedron having magnet means employed in its faces according to the present invention, FIG. 1*a* is an enlarged sectional view through one face of the octahedron as shown in FIG. 1, FIG. 3 is an illustration of the present invention applied to a hexagonal prism.

DESCRIPTION OF THE INVENTION

Figure 2:
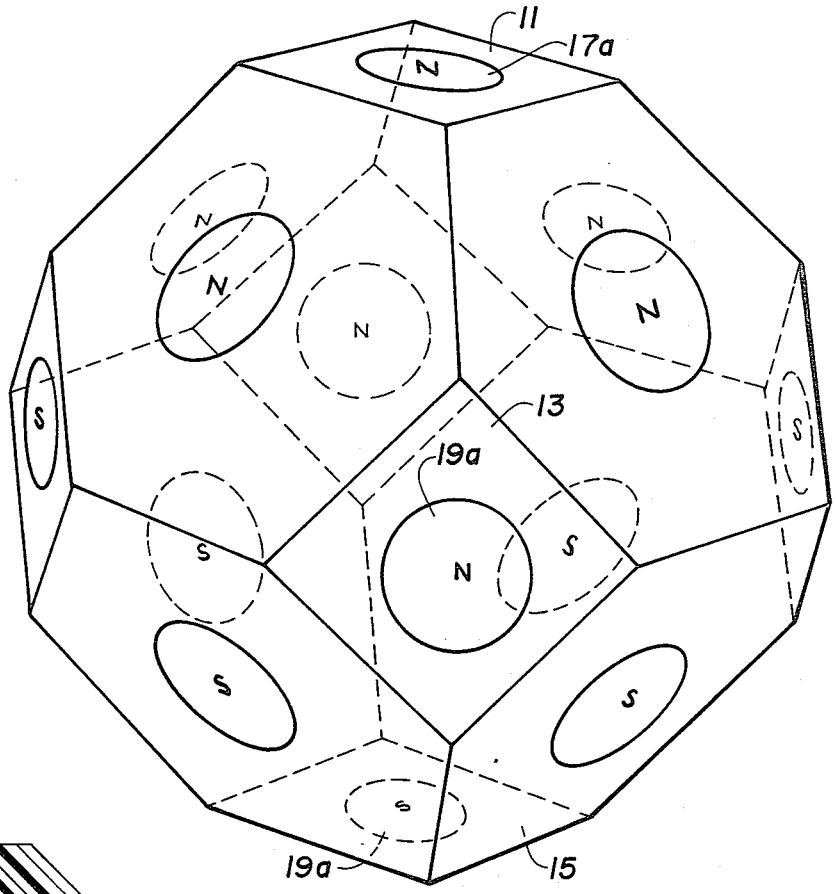
FIG. 2 is a diagrammatic illustration of a truncated octahedron in which rod magnets are employed.

Referring now to FIG. 1, the present invention is embodied in an arrangement comprising one or more truncated regular octahedrons each having fourteen faces of which two may be defined as polar squares that lie transversely to the vertical axis through the center of the body so that they are on top and bottom respectively, as shown at 11, four are equatorial squares 13 and eight are hexagonal as shown at 15. In accordance with the present invention the polar square faces 11 are each provided with a magnet 17, the equatorial square faces with magnets 19 and the remaining faces provided with magnets 21. Magnetically attractive disks, plates, washers or similar means may be employed in lieu of some of the magnets since when arranged adjacent to each the strength of the magnetic field of one face may be sufficient to hold the figure unit of the other only with a magnetically attractive means created by one active magnet.

In the embodiment shown in FIG. 1, all of the faces of the truncated regular octahedron are provided with magnets 21 embedded in the surface thereof as shown in FIG. 1*a* having the poles arranged at opposite ends thereof, such as in a bar magnet. In this embodiment both poles of the magnet are "magnetically" exposed to the exterior of the figure unit. In general, the octahedron may be viewed as a globe, and the disposition of the squares, hexagons and magnets are oriented in global formation. The polar squares 11 have the north and south poles of their magnets 17 oriented oppositely but the axes of the magnets are oriented along a meridian line of the globe and within a square (i.e. lying on a longitudinal plane of the globe). The meridian line chosen is one dividing pairs of opposing sides of the polar squares as exemplified in FIG. 7. The magnets 21 located in the hexagonal faces 15 have their north and south poles oriented along a latitude line dividing the hexagonal faces in two halves and passing through a pair of diametrically opposite points lying on the junction or corners of the opposite sides of each hexagonal face in a circumferential or latitudinal direction. The magnets 19 located in the equatorial square faces 13 of the octahedron have the north and south poles oriented along axes which diagonally bisect those square faces in a circumferential direction along the equator, or greater circle.

Figure 2A:
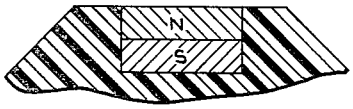
FIG. 2*a* is an enlarged sectional view through one face of the truncated octahedron of FIG. 2.

In FIG. 2 a truncated regular octahedron similar to that of FIG. 1 is shown; however, here the magnets are of the axial type such as rod magnets and have their poles at opposite facial sides only one of which is exposed exteriorly of the figure (as seen in FIG. 2*a*). The polar squares 11 have magnets 17*a* which face outwardly in opposition direction; the equatorial squares 13 have magnets 19*a* of alternating polarity (i.e. one north, one south circumferentially about the figure); while the hexagonal polygons are divided into two hemispheric groups in which those of each group have a magnet in which the polarity conforms to the adjacent polar square polarity.

FIG. 3 shows the invention applied to a hexagonal prism. Such a figure comprises a pair of polar hexagons 23 and six quadralateral sides 25. The polar hexagons 23 are provided with magnet pieces 27 of opposite polarity orientation while the quadralateral sides have alternating polarity magnets 29. The magnets may each be arranged with the axis of the poles oriented either crosswise of the meridian or of the horizontal dividing line of the hexagons.

Figure 4:
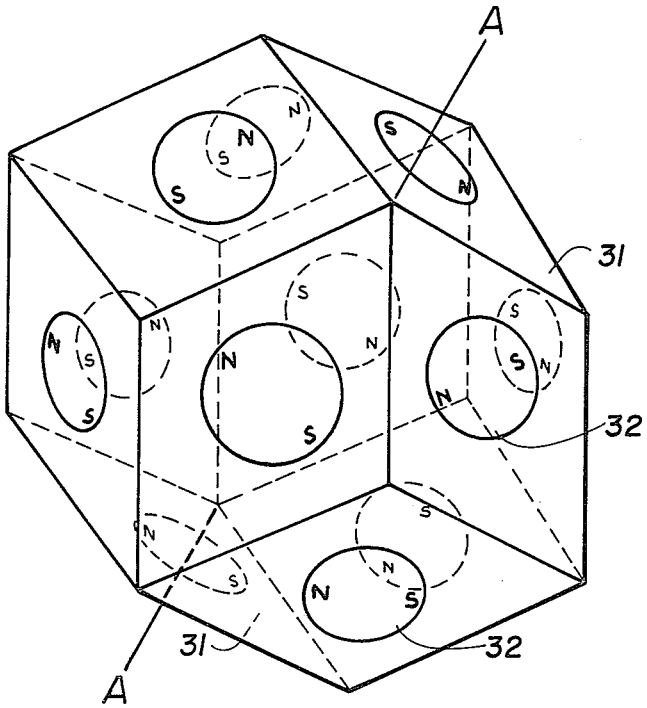
FIG. 4 is an illustration of the present invention applied to a rhombic dodecahedron.

FIG. 4 shows the invention applied to a rhombic dodecahedron comprising twelve paired faces 31 of rhombic form. The faces are provided with disk shaped bar magnets 32 poled in accordance with the vertex method to be hereinafter described using vertices A.

Figure 5:
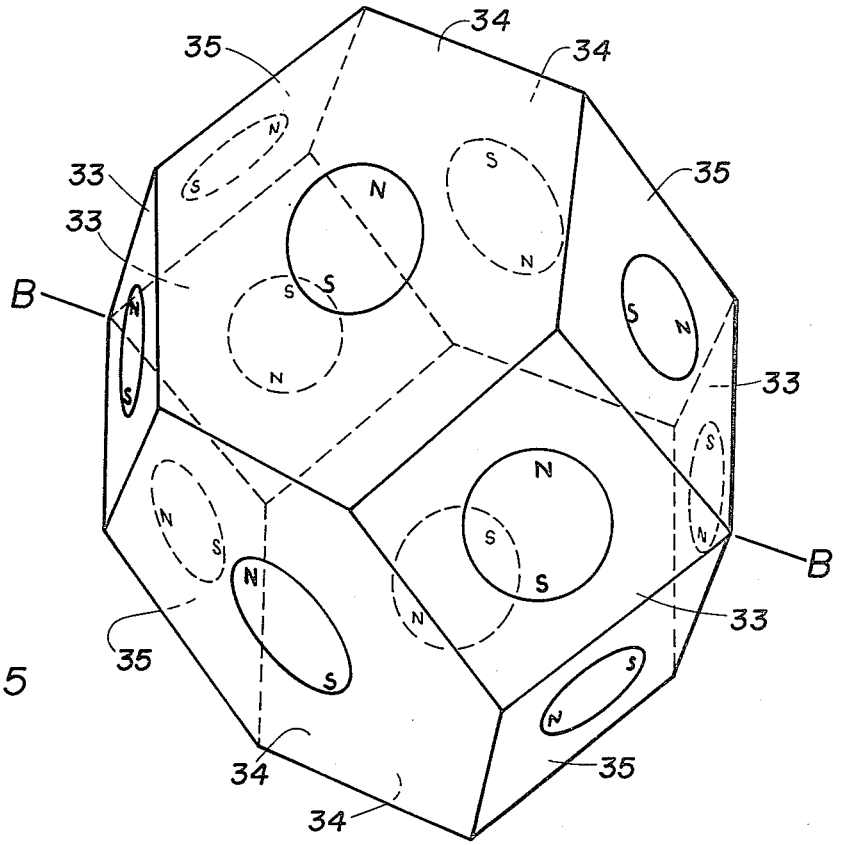
FIG. 5 is an illustration of the present invention applied to Murray's dodecahedrons.

FIG. 5 shows the invention applied to Murray's dodecahedron which comprises four square faces 33, four hexagon faces 34 and four rhombic faces 35. This shape is poled according to the vertex polar method herein described using vertices B.

It will be apparent from the foregoing that generally any close packing solid can be fitted with magnets or magnetic means so that they may be combined in various combinations to form interesting arrangements which are artistic, decorative and amusing. Such arrangements can be made from sets of any number of identical solids, since the total of each set will have the ability to close pack in space without the edges of one face of one solid overlapping the edges of the contiguous face of the solid in abutting relationship and without interstices being formed between abutting ones of said solid.

The solids of each set can be added to each other in many ways even where less than all faces have magnets so long as those missing faces have magnet attractive means. Greater variety and reliability is, however, possible in magnet to magnet connection. However, magnet to magnet connection in an arrangement where less than all faces have magnets is somewhat impractical since even if correctly aligned the holding capacity of the other faces are wasted. In contrast, where magnets are employed in all of the faces as shown in the figures, and aligned in accordance with the arrangement illustrated with regard to orientation of the north and south poles, the solids can be held together strongly in any position so long as the two polar magnets in each of the solids are arranged in the same direction. Consequently, regardless of the number of magnets employed, it is a challenge to devise a complete arrangement from a plurality of units due to the fact that the magnetic polar positions of each unit is unknown and unseen, and to find the particular orientation of each unit so that the units can be operatively connected to one another. On the other hand, it will be obvious from the arrangement of the magnetic means shown in the drawing and described above that it is not possible to arrange a plurality of the units in any manner. Some limitation is placed on the successful arrangement by the specific location of the poles of the magnets and their respective form, since the predetermined polarity and/or direction of polarity limits the face to face abutment of the members of each set. This, however, enhances the amusement value of the invention. Once, however, the proper relationship of the adjacent solid figures has been established (by trial and error) the user of the device may erect any sculptural or architectural form or shape he so desires.

Figure 6:
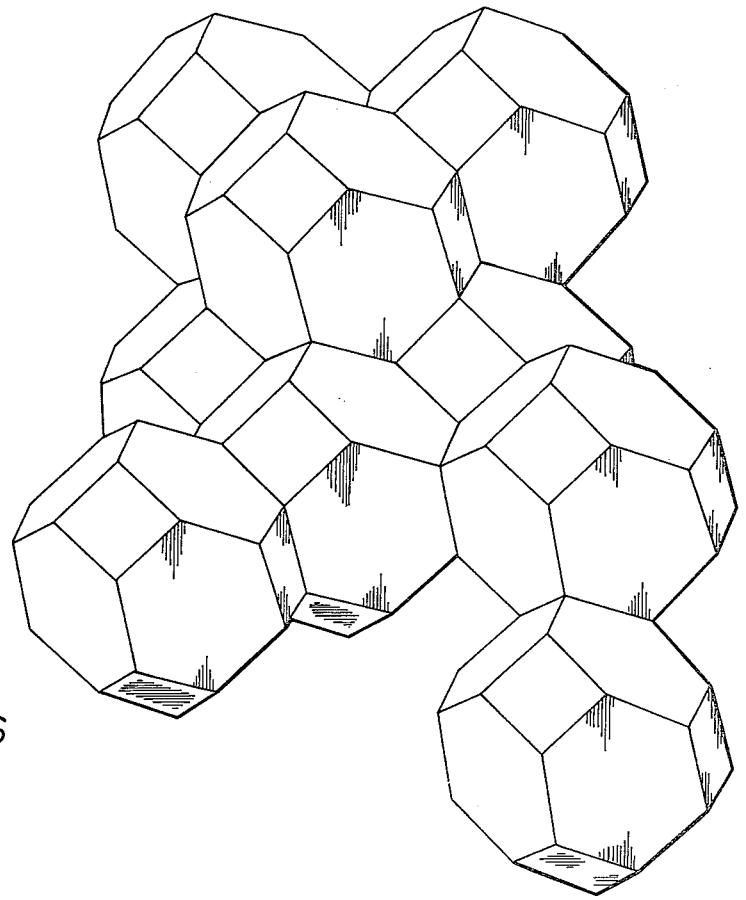
FIG. 6 is an illustration of a plurality of units shown in FIGS. 1 and 2 exemplifying one assembled arrangement according to the present invention.

One such free form construction is illustrated in FIG. 6 where a plurality of truncated octahedrons of the type shown in FIG. 1 are arranged. It will be noted that not only can the polar squares be abutted but that each and every face may, as desired or selected, be brought into abutting relationship with one or more adjacent error is required in order to properly mate the magnets together. Since the magnets will be preferably embedded below the surface of the face this trial and error exercise provides a satisfactory degree of "play" and experimentation.

The units per se may have hollow interiors. They can be made of wood, plastic, metal, or other suitable materials. Where they are made of a material other than metal, if desirable, the surfaces can be coated with a metallic finish. The lighter in weight the units are, the easier they are to hold together and with less force. Consequently, it is generally preferred that they be made of hollow light weight materials such as plastics or thin sheet metals.

The arrangement of the magnets may conform to some general rules of application related to the polar axis or polar line of the solid. In FIGS. 4 and 5, a first method of finding the polar axis is found by drawing a line A—A between any two vertices lying opposite to each other and passing through the center of the solid. (This may also be called the vertex polar axis.) Planes are drawn perpendicular to the polar axis intersecting the center of each of the polygon faces and also intersecting the polar axis so that all polygon faces have lines defined by the planes intersecting them. When bar magnets are used each magnet is then laid in the center of each face along a line coincident with its associated perpendicular plane so that the poles of all the magnets lie in the perpendicular plane pointing in the same direction or with the same polarity. Thus, when the solid is viewed directly along its polar axis, the magnets lie on a plurality of circles concentric to the axis. Thus, the direction of polarity moves in the same direction around the polar axis. All solids of a single set or group should be poled and the magnets placed in exactly the same way, otherwise the units could not be close packing because the magnets of one unit would repel rather than attract in the desired position.

When using rod magnets an additional step may be required as it is necessary to first draw an equatorial plane perpendicular to the polar axis bisecting the axis midway along its length. All polygon faces laying to one side of the equatorial plane are then poled with common magnetic polarity while all polygon faces in the other hemisphere are similarly poled but with opposite polarity; those polygon faces lying in the equatorial plane being poled alternately.

Figure 7:
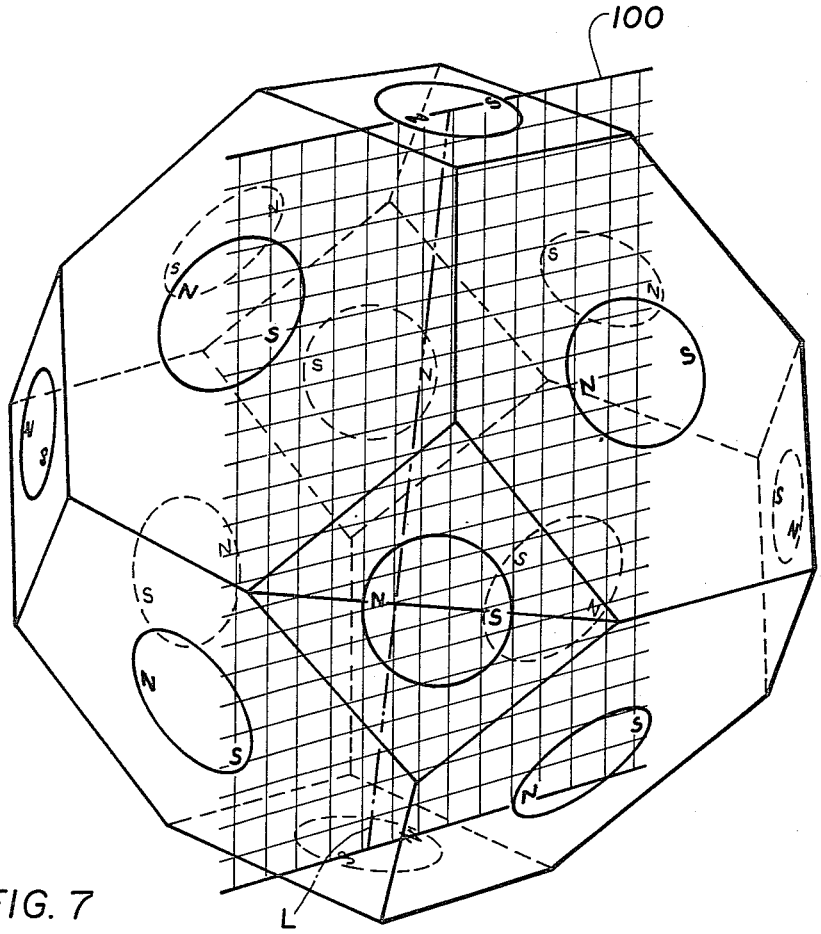
FIG. 7 is a view showing a method of establishing the polarity for the magnets of the solid.

A second method for finding the polar axis and for poling the solid can also be employed particularly in those solids having opposed polar faces as in FIG. 3. Such a technique is illustrated in FIG. 7. A line L is drawn between the centers of two opposed polar faces passing through the center of the solid. This may be called the facially polar line. A plane 100 is then drawn passing coincident with this line and through each of the centers of opposite sides of the polygon of the respective polar faces. Planes perpendicular to the polar plane 100 are drawn through the center of each of the other faces to provide a plurality of parallel planes some of which are at acute angles to the surface of the associated face. The planes passing through the equatorial faces form a plane dividing the solid into hemispheres. Magnets are then placed on each face directly at the center of the face and passing through the plane drawn through the face. When bar magnets are used the magnets in the polar polygons are placed in reversed order, however, the other faces are placed with their respective poles facing the same direction. When rod magnets are used the magnets in each hemisphere are of opposite polarity while in the faces passing through the equator they alternate. This method may be used to polarize the polyhedron of FIG. 3, although the method is then simplified by requiring only one perpendicular plane and one polar line.

With the above in mind any solid can be fitted with magnets and polarized to provide optimum results.

The units, each comprising a magnetized shape per se, may be solid throughout or they may have hollow interiors. They can be made of wood, plastic, metal or other suitable materials and where they are made of material other than metal, if desirable, the surface can be coated with a metallic finish. The lighter in weight the units are the easier they are to hold together and with less force as stated previously. Consequently, it is generally preferred that they be made of hollow light weight materials such as plastics or thin sheet metals.

The magnets are set flush with or just below the surfaces in which they are employed. The magnets may be adhered by suitable adhesives, welded or fastened by mechanical fastening means or they may be molded directly into or onto the surfaces of the faces. The means for adhering the magnet means is not critical. Moreover, the holding means in the cases where there are magnets and magnetically attractive material, such as disks can have any suitable shape so long as the north and south poles of the magnets are properly oriented, especially in an arrangement wherein the holding means can be rectangular, square, circular, triangular, or have any other suitable shape, as may the magnetically attractive non-magnet holding means.

The geometric solid figures and the holding means, both magnetic and otherwise, employed in this invention can be made by a variety of simple practices. For example, where magnets or magnets and disks, washers or similar means are used, the geometric solid units are preferably hollow to cut down on weight and may be made by known blow molding techniques employing a suitable mold and a "tree" or form composed of branches or spoked radiation from a central base and having magnets or washers or the like fixed to each of the branches. The form is then placed in the mold and a suitable paste is blown in resulting in a hollow solid with the magnets and washers of the like molded in place in the faces. In a similar method hollow solid which is blow molded in the faces to accommodate the magnets and/or magnets and washers or the like. The magnets and/or washers are then simply set in the depressions with glue.

Sheet metal faces can be welded or soldered together, whereas wooden faces may be glued or nailed if desired. Preferably, the units should be made of sizes between 1–4 inches in overall diameter, in order to facilitate handling and manipulation. Size, however, is not critical and other dimensions can be, of course, used.

It may be desired to add ferrous material to the plastic material or to form the solid out of wholly ferrous metal in order to enhance the magnetic power of the device.

Regardless, of which particular construction is employed, a wide variety of coatings and finishes may be used for decorative purposes. In this connection colored plastics can also be used. Moreover, metal coatings can also be employed to make an attractive finish by utilizing vacuum metallizing processes that are known. In this manner an attractive finish of copper, bronze, silver, gold, or blue steel can be achieved.

It will also be apparent that other means may be used to join the respective unit of each set, rather than magnets or magnetic means while preserving the artistic and amusement value of the invention. Differently shaped pegs, keys, keyways etc., may be used in place of the polarized magnets to give the same effect of requiring and necessitating a predetermined array and arrangement of the units in each set. The pegs or keys may be arranged in combinations, or alternating regularity, hemispherical similarity, etc., as previously described. Such arrangement will be obvious from the foregoing.

Furthermore, as a practical matter, a plurality of magnetic "keepers" equal to the number of magnets can be supplied with each unit to prevent the magnetic fields from growing weak. The "keepers" may be washers or the like provided with felt bottoms and small handles to grip them.

Numerous variations of this invention may be made without departing from the spirit and scope thereof. Accordingly, the invention is not to be limited except as defined in the appended claims.

What is claimed:

1. Sculptural objects comprising a plurality of identical geometric solid units each having a plurality of faces of at least two different polygonal shapes and collectively capable of random assembly into close packing spatial arrangements wherein there are no overlapping edges or interstices between abutting units, the mutually opposed similarly configured faces of each unit respectively having first and second magnet means of fixed oppositely oriented magnetic polarity, the magnetic poles of said first magnet means of one unit and the magnetic poles of the second magnet means of another unit being thus cooperable magnetically in selected pairs to join said units together in a predetermined manner and in a close packing arrangement, each said unit being a truncated regular octahedron and said magnet means being bar magnets one located at each polyhedron face, said bar magnets in the polar square polygonal faces having their north and south poles oriented along a circumferential line dividing pairs of opposite sides of said polar square faces, the magnets located in the equatorial square faces having their north and south poles oriented along a line bisecting pairs of opposite angles of said equatorial square faces in a circumferential direction and the magnets located in the hexagonal faces having their north and south poles oriented along lines bisecting pairs of opposite angles of said hexagonal faces and passing through points lying in a circumferential direction parallel to latitudinal circles.

2. Sculptural objects as defined in claim 1, wherein said geometric solid units are solid.

3. Sculptural objects as defined in claim 1, wherein said geometric solid units are hollow.

4. Sculptural objects as defined in claim 1, wherein the polygonal surfaces of each unit are covered with a metallic coating.

* * * * *